US005375298A

United States Patent [19]

Nakamura et al.

[11] Patent Number: 5,375,298

[45] Date of Patent: Dec. 27, 1994

[54] APPARATUS FOR PRODUCING A FIBER WEB

[75] Inventors: Tatsuo Nakamura, Sowa; Shinich Kitazawa, Koga; Takeshi Ogino, Itakura; Ken Waku, Oyama, all of Japan

[73] Assignee: Japan Vilene Company, Ltd., Japan

[21] Appl. No.: 907,022

[22] Filed: Jul. 1, 1992

[30] Foreign Application Priority Data

| | | | |
|---|---|---|---|
| Jul. 2, 1991 | [JP] | Japan | 3-188095 |
| Dec. 17, 1991 | [JP] | Japan | 3-353288 |
| Dec. 27, 1991 | [JP] | Japan | 3-359418 |

[51] Int. Cl.[5] ..... D01G 25/00; D01G 27/00; D01G 15/12

[52] U.S. Cl. ..... 19/296; 19/112; 19/99; 19/304

[58] Field of Search ..... 19/99, 100, 101, 105, 19/204, 296, 297, 301, 304, 98, 112

[56] References Cited

U.S. PATENT DOCUMENTS

| | | | |
|---|---|---|---|
| 2,589,008 | 3/1952 | Lannan . | |
| 2,639,759 | 5/1953 | Simison . | |
| 3,894,315 | 7/1975 | Fukuta et al. | 19/296 X |
| 4,090,276 | 5/1978 | Roberts | 19/99 |
| 4,115,903 | 9/1978 | Barber | 19/99 |
| 4,130,915 | 12/1978 | Gotchet et al. | 19/101 X |
| 4,219,908 | 9/1980 | Wimch et al. | 19/99 |
| 4,280,253 | 7/1981 | Holt | 19/296 |
| 4,284,595 | 8/1981 | Peters et al. | 19/296 X |
| 4,534,086 | 8/1985 | Fehrer | 19/99 |
| 4,615,080 | 10/1986 | Wirth | 19/296 X |

FOREIGN PATENT DOCUMENTS

| | | | |
|---|---|---|---|
| 0093585 | 11/1983 | European Pat. Off. . | |
| 90000639 | 1/1990 | European Pat. Off. . | |
| 2207512 | 9/1973 | Germany . | |
| 0004129 | 2/1978 | Japan | 19/296 |
| 880698 | 12/1959 | United Kingdom . | |

*Primary Examiner*—Clifford D. Crowder
*Assistant Examiner*—John J. Calvert
*Attorney, Agent, or Firm*—Fish & Richardson

[57] ABSTRACT

The present invention relates to an apparatus for producing a fiber web comprising a feeder 1 for supplying a fiber material, a plurality of fiber opening cylinders $2_1$, $2_2$, $2_3$, . . . 2n (n is a natural number) mounted adjacent to one another for transferring and opening the fiber material fed from the feeder 1 and having metallic wires *2a* mounted to the surface thereof, a conveyor 7 arranged for receiving the opened fiber unloaded from the fiber opening cylinder 2n mounted at the outlet end, and a suction box 8 arranged beneath the conveyor 7 for drawing the opened fiber towards the conveyor 7 by a sucking action, said fiber opening cylinders $2_1$, $2_2$, $2_3$, . . . 2n being enclosed in a housing 3 which has fiber transfer openings 4 between any two adjacent fiber opening cylinders and a fiber releasing opening 5 for unloading the opened fiber from the last fiber opening cylinder 2n, and also arranged so that any two adjacent cylinders can rotate in opposite directions. The present invention also provides a method of producing a fiber web using the above apparatus, in which at least one of the fiber opening cylinders $2_1$, $2_2$, $2_3$, . . . 2n is driven to produce a centrifugal acceleration of more than $3.4\times10^5$ cm/sec$^2$ for acting on the fiber material.

As a result, a fiber web which is non directional and uniform is produced. Also, a fiber web in which the containing ratio of each fiber material gradually increases or decreases to the direction of the thickness of the fiber web, will be produced from two or more different fiber materials which are different in the resistance to peeling on the last fiber opening cylinder 2n. With the use of the apparatus or method of the present invention, a fiber web can be produced which is applicable to unwoven fabrics, filters, battery separators, FRP substrates, adhesive tapes, etc.

2 Claims, 6 Drawing Sheets

APPARATUS FOR PRODUCING A FIBER WEB

BACKGROUND OF THE INVENTION

1. Field of the Invention

The present invention relates to an apparatus and a method of producing a fiber web in a dry technique and, more particularly, an apparatus and a method of producing a non-directional (non-oriented) fiber web.

Also, the present invention relates to a fiber web produced from two or more different fiber materials in which the fiber containing ratio of each fiber material to the direction of the thickness of the web is gradually increases or decreases to the direction of the thickness of the fiber web and also, a method of producing the same.

Furthermore, the present invention relates to a fiber web which provides no abrupt change in the physical characteristics to the thickness direction of the fiber web and is thus useful as raw material for a filter, a battery separator, a FRP(fiber reinforced plastics) substrate, an adhesive tape, and so on.

2. Description of the Prior Art

A known apparatus for producing a non-directional fiber web using a dry technique is provided in which fiber material(s) is opened with cylinders equipped with wires, workers, and/or strippers and then, blown by air or sucked.

Also, a prior art apparatus is disclosed (in Japanese Patent Publication No. 31807/1991) in which a fiber material is combed between cylinders which are arranged in a row and rotated in one direction while excessive fibers failing to be transferred to the succeeding cylinder are blown out, and the obtained fiber material is piled.

However, these prior art apparatus are not sufficient for producing a fiber web which is uniform and has no orientation of the web.

It is known that a fiber web is processed to a nonwoven fabric for use as a filter. For increasing the filtering capability and the operational life of a filter, two or more laminated layers of nonwoven fabrics made of fiber materials which are different in fiber diameter are commonly used. Such laminated nonwoven fabrics having two or more layers produce interfaces between layers where pressure loss tends to be increased sharply, and the life of the filter will be shortened. As the physical characteristics are varied abruptly at the interface of the lamination of the nonwoven fabric, the performance of the filter is diminished.

A fiber reinforced plastic (FRP) substrate web is disclosed in Japanese Patent Application Laid-open No. 47740/1991, which comprises monofilaments at one surface side and strands at the other side. Such a substrate web is produced in a manner that when the web is unloaded from the drum, heavy fiber is piled up near the drum and light fiber is piled up far from the drum. This requires that the fiber material contain more than 50% by weight of strands while the rest is made of monofilaments. It is quite difficult to open a given amount of strand to monofilament. Also, a resultant fiber web becomes coarse because of the strand concentrating near the surface.

SUMMARY OF THE INVENTION

It is an object of the present invention to provide an apparatus and a method of producing a non-directional fiber web through a fiber opening by a novel principle different from those of the prior art.

It is another object of the present invention to provide an apparatus and a method of producing an improved fiber web which carries less neps, namely fiber clusters generated by entangling of fibers, even if organic fibers having a tendency to generate neps are used.

It is a further object of the present invention to provide an improved fiber web made of two or more different fiber materials and a method of producing the same, in which the containing ratio of each fiber material gradually increases or decreases to the direction of the thickness of the fiber web and thus does not cause an abrupt change of the physical characteristics to the thickness direction so that the fiber web can successfully be used as a filter, a battery separator, an FRP substrate, an adhesive tape, or the like.

It is a still further object of the present invention to provide a fiber sheet on which active carbons are adhered to the fibers thereof as a preferred embodiment and a method of producing the same.

An apparatus for producing a fiber web according to the present invention comprises: a feeder 1 for supplying a fiber material; a plurality of fiber opening cylinders having metallic wires mounted to the surface thereof, said cylinders mounted adjacent to one another for transferring and opening the fiber material fed from the feeder 1; a conveyor 7 arranged for receiving the opened fiber unloaded from the fiber opening cylinder 2n mounted at the outlet end; and a section box 8 arranged beneath the conveyor 7 for drawing the opened fiber towards the conveyor 7 by a sucking action. In particular, the fiber opening cylinders $2_1$, $2_2$, $2_3$, . . . 2n are enclosed in a housing 3 which has fiber transfer openings 4 between any two adjacent fiber opening cylinders and a fiber releasing opening 5 for unloading the opened fiber from the last fiber opening cylinder 2n, and also arranged so that any two adjacent cylinders rotate in opposite directions.

A method of producing a fiber web, which is non directional and uniform in fiber assignment, for use with the above apparatus, according to the present invention, comprises the step of while driving said fiber opening cylinders. $2_1$, $2_2$, $2_3$, . . . 2n so that any two adjacent cylinders rotate in opposite directions, rotating at least one of them to produce a centrifugal acceleration of more than $3.4\times10^5$ cm/sec$^2$ for beating the fiber material.

Also, another apparatus for producing a fiber web to diminish generation of neps according to the present invention comprises at least:

a first fiber opening device comprising a feeder 11 for supplying a fiber material, two fiber opening cylinders $12_1$, $12_2$ mounted adjacent to each other for transferring and opening the fiber material fed from the feeder 11 through rotation in opposite directions and having metallic wires mounted to the surface thereof, a housing 13 enclosing the two fiber opening cylinders $12_1$, $12_2$ and having a fiber transfer opening 14 between the fiber opening cylinders $12_1$, $12_2$ and a fiber releasing opening 15 for unloading the opened fiber from the last fiber opening cylinder $12_2$, a conveyor 17 arranged for receiving the opened fiber unloaded from the fiber opening cylinder $12_2$ mounted at the outlet side, and a suction box 18 arranged beneath the conveyor 17 for drawing the opened fiber towards the conveyor 17 by a sucking action; and a second fiber opening device comprising two fiber opening cylinders $22_1$, $22_2$ mounted adjacent to each other for transferring and opening the fiber material fed from the conveyor 17 of the first fiber opening device through rotation in opposite directions and having metallic wires mounted to the surface thereof, a housing 23 enclosing the two fiber opening cylinders $22_1$, $22_2$ and having a fiber transfer opening 24 between the fiber opening cylinders $22_1$, $22_2$ and a fiber releasing opening 25 for unloading the opened fiber from the last fiber opening cylinder $22_2$, a conveyor 27 arranged for receiving the opened fiber unloaded from the fiber opening cylinder $22_2$ mounted at the outlet side, and a suction box 28 arranged beneath the conveyor 27 for drawing the opened fiber towards the conveyor 27 by a sucking action.

Another method of producing a fiber web carrying less neps, for use of the above apparatus, comprises the step of driving at least one of the fiber opening cylinders $12_1$, $12_2$, $22_1$, $22_2$ to produce a centrifugal acceleration of more than $3.4\times10^5$ cm/sec$^2$ for acting on the fiber material fed from the feeder 11.

A fiber web according to the present invention comprises two or more different types of opened fiber materials in which the containing ratio of each fiber material gradually increases or decreases to the direction of the thickness of the fiber web.

A method of producing the above fiber web for use with the foregoing apparatus according to the present invention comprises the steps of driving the fiber opening cylinders $2_1$, $2_2$, $2_3$, . . . 2n so that any two adjacent cylinders rotate in opposite directions.

DETAILED DESCRIPTION OF THE INVENTION

Figure 1:
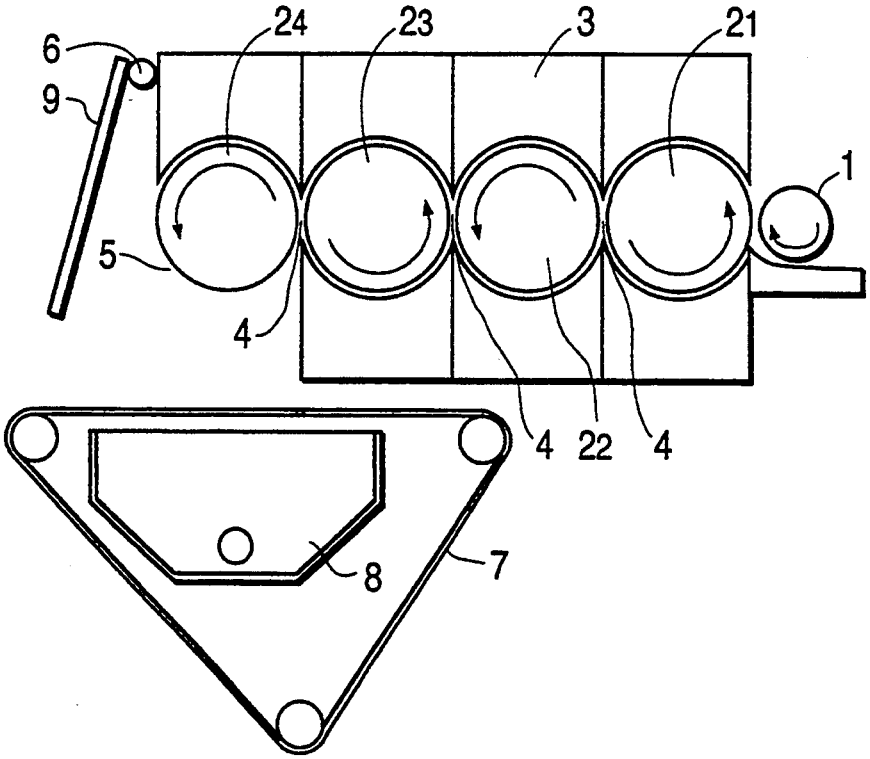
FIG. 1 is a cross sectional view of a fiber web producing apparatus showing one embodiment of the present invention.

Referring to FIG. 1, the present invention will be described in the form of, but not limited to, a fiber web producing apparatus provided with four fiber opening cylinders. FIG. 1 is a cross sectional view of the apparatus of the present invention.

As shown in FIG. 1, a feeder 1 is provided for feeding an amount of fiber material to a fiber opening cylinder $2_1$. The fiber material to be fed may be an unopened raw material. However, somewhat opened fibers will easily be processed to a uniform and non-directional web. Hence, the fiber material is preferably fed in the form of a rough fiber web prepared by e.g. a card machine in a preceding step. Although the rotating direction of the feeder 1 is not specified, it can desirably be rotated to the direction that the fiber material is fed at the lower part of the feeder so that the fiber material runs into the fiber opening cylinder $2_1$ without escaping backward.

According to the present invention, four fiber opening cylinders $2_1$, $2_2$, $2_3$, $2_4$ are arranged in a row so that any two adjacent cylinders rotate in opposite directions for beating the fiber material against the inner wall of a housing 3 by means of a centrifugal accelerating force. If the fiber opening cylinders $2_1$, $2_2$, $2_3$, $2_4$ are rotated in the same direction, they produce combing actions between any two adjacent cylinders thus increasing unwanted frictional force. This diminishes the centrifugal acceleration force when the fiber material is beaten against the inner wall of the housing 3 and results in unsatisfactory opening action or entanglement of, and damage to the fiber material.

Specifically, the "centrifugal acceleration" for the fiber material is expressed by $rw^2$ which represents an accelerating element of the centrifugal force $F=mrw^2$ produced on the fiber material by the rotation of the cylinder, where m is the mass of the fiber material, r is a radius of the cylinder, and w is an angular speed of the cylinder.

Even if the fiber opening cylinders $2_1$, $2_2$, $2_3$, $2_4$ are rotated in the opposite directions alternately, it is not sufficient if the rotation speed is slow. Because a slow speed rotation can transfer the fiber material forward but not contribute to the fiber opening action. Therefore high speed rotation is preferable. Preferably, the high-speed rotation should be at as high as over 2500 revolutions per minute, as compared with 300 to 500 rpm of traditional cylinders. All of the fiber opening cylinders $2_1$, $2_2$, $2_3$, $2_4$ may not rotate at a high speed but it would be preferable that at least one of them rotates at the high speed. It is preferable that the fiber opening cylinder $2_1$ next to the feeder 1 rotates at a lower speed than the other three cylinders $2_2$, $2_3$, $2_4$ for minimizing undue damage to the fiber material.

Also, the radius of the fiber opening cylinders $2_1$, $2_2$, $2_3$, $2_4$ is preferably less than 50 cm for high speed rotation but greater than 5 cm for performing a fiber opening action at a favorable efficiency. If the rotation of the cylinders is 2500 rpm and the radius is 5 cm, the centrifugal acceleration for the fiber material is equal to $5\times(2500\times2\pi/60)^2=3.4\times10^5$ (cm/sec$^2$). In practice, a value higher than that is desired.

While the feeder 1 rotates so as to feed the fiber material from its lower part, the rotation of the fiber opening cylinder $2_2$ should be in the same direction as of the feeder 1. If the fiber opening cylinder $2_2$ rotates in an opposite direction, the fiber material may be pushed backward. Preferably, the rotating direction of the fiber opening cylinder $2_4$ mounted at the outlet side is such that the fiber material is released from an upward position to a downward position to free fall in the form of a laminar flow through the air thus to obtain a non-directional fiber web.

Figure 2:
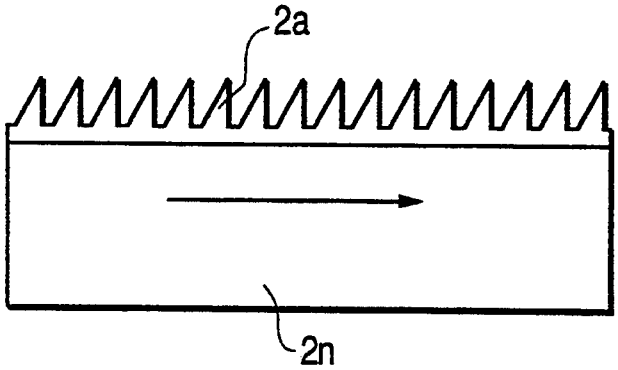
FIG. 2 is a partially enlarged cross sectional view of a fiber opening cylinder equipped with a metallic wire according to the apparatus of the present invention.

As shown in FIG. 2 which is a partially enlarged cross sectional view of one preferred embodiment of the fiber opening cylinder, each of the fiber opening cylinders $2_1$, $2_2$, $2_3$, $2_4$ has a metallic wire 2*a* mounted to the surface thereof for throwing away pieces of the fiber material with its teeth. The metallic wire 2*a* is formed in a plate shape having a sawtooth blade, as shown in FIG. 2 for example.

At least two or more of such fiber opening cylinders $2_1$, $2_2$, $2_3$, $2_4$ which are equipped with the metallic wires 2*a* are aligned in a row. It is preferable that the apparatus has an even number of the fiber opening cylinders taking into consideration the correct rotating direction of the feeder 1, the reverse rotating direction of the fiber opening cylinder $2_1$ arranged adjacent to feeder 1, the rotating direction of the last cylinder for unloading the opened fiber material downward, and the opposite rotations of any two adjacent cylinders.

The fiber opening cylinders $2_1$, $2_2$, $2_3$, $2_4$ are installed in the housing 3 against which the fiber material is beaten for opening by the force of centrifugal acceleration on the fiber opening cylinders $2_1$, $2_2$, $2_3$, $2_4$. More specifically, the fiber opening cylinders $2_1$, $2_2$, $2_3$ except the last cylinder $2_4$ are fully enclosed in the housing 3 which has interior transfer openings 4 through which the fiber opening cylinders $2_1$, $2_2$, $2_3$, $2_4$ are communicated with one another for transfer of the fiber material. The housing 3 at the portion of the fiber opening cylinder $2_4$ of the outlet end has an opening 5 arranged wider than the transfer openings 4 for allowing the opened fiber material to be released without interference of the housing 3 as being forced out by the centrifugal acceleration.

If the inner wall of the housing 3, against which the fiber material is beaten for opening action, has a similar sawtooth surface like the metallic wires 2*a*, the fiber material may be hooked up by jamming. As a result, the centrifugal acceleration force by the fiber opening cylinders $2_2$, $2_3$ will decline thus discouraging the opening action. It is thus preferred to not have a toothed arrangement on the inner wall of the housing 3.

If the distance between the inner wall of the housing 3 and the top of the metallic wires 2*a* of the fiber opening cylinders $2_1$, $2_2$, $2_3$, $2_4$ is less than 0.1 mm, the fiber material will easily clog up to interrupt the opening action by the centrifugal acceleration. If the distance is over 5.0 mm, the beating of the fiber material against the housing 3 by the centrifugal acceleration force will be lessened. It is then desired that the distance be between 0.1 and 5.0 mm and more preferably, within a range of 0.5 to 1.5 mm.

The fiber material released from the last fiber opening cylinder $2_4$ spontaneously falls down onto a conveyor 7 where the fiber material is caught and a non-directional fiber web is produced. At that time, a downward force is applied by the sucking action of a suction box 8 to the fiber web on the conveyor 7 for the purpose of increasing strength.

As the opened fiber is forced outward by the centrifugal acceleration on the last fiber opening cylinder $2_4$, it tends to concentrate in one particular direction tangential to the circumference of the fiber opening cylinder $2_4$. To compensate, an air shower device 6 is provided above the fiber releasing point on the fiber opening cylinder $2_4$ so that the opened fiber can be scattered to form a uniform fiber web. If the air flow from the air shower device 6 is directly applied to the opened fiber, a turbulent flow of air is developed preventing free fall of the fiber material. This will result in no uniformity of the finished fiber web. It is thus desired that the air flow is used for no direct application to the opened fiber but to generate a laminar flow of air at the circumference.

For this purpose, a cover 9 is provided at the outlet end and the air shower device 6 is mounted above the fiber releasing point on the fiber opening cylinder $2_4$ at the outlet end and is arranged to blow air along the inner wall of the cover 9. Adopting such indirect air flow, the air flow generates a pressure difference thus drawing the fiber material located near the portion of the air flow and a uniform fiber web is obtained.

The opened fiber from the fiber opening cylinder $2_4$ is drawn towards the conveyor 7 by the sucking action of the suction box 8 and accumulates on the conveyor 7 to a uniform fiber web having strength enough to be handled without difficulty.

If the conveyor 7 is spaced far from the fiber opening cylinders $2_4$, the opened fiber tends to form clusters while falling down. A desired distance between the fiber opening cylinder $2_4$ and the conveyor 7 may be determined depending on the centrifugal acceleration of the fiber opening cylinder $2_4$ and the amount, pressure, or absence of air flow from the air shower device 6.

Also, the cover 9 is preferably arranged for protecting the space between the fiber opening cylinders $2_4$ and the conveyor 7 for allowing the opened fiber to fall down spontaneously without interference from the outside.

A method of producing a fiber web will now be described using the fiber web producing apparatus of the foregoing embodiment.

In action, the fiber fed from the feeder 1 is beaten against the inner wall of the housing 3 by the centrifugal acceleration force of the fiber opening cylinders $2_1$, $2_2$, $2_3$, $2_4$.

As the fiber material used in the method, for example regenerated fiber such as rayon, half-synthetic fiber such as acetate fiber, vegetable fiber such as cotton, animal fiber such as wool, mineral fiber such as asbestos, inorganic fiber such as glass carbon fiber, and synthetic fiber such as polyamide, polyester, or polypropylene fiber are mentioned. The apparatus has the fiber opening cylinders $2_1$, $2_2$, $2_3$, $2_4$ which are equipped with the metallic wires 2*a* for catching and throwing pieces of the fiber material towards the inner wall of the housing 3 for fiber opening action. If the fiber material has many crimps or is too soft, it is easily entangled with the sawteeth of the metallic wires 2*a* disturbing a continuous fiber opening action. Therefore, less crimped and relatively stiff fiber material is preferably used. If the length of fiber is too long, entanglement on the metallic wires 2*a* may be unavoidable. If too short, the fiber material may not be hooked by the sawteeth of the metallic wires 2*a*. Thus the fiber length is desired to be about 3 to 30 mm.

The fiber material is fed by feeder 1. The rotation direction of the feeder 1 is preferably in such a direction that the fiber material can be fed at the lower part of the feeder 1, so that it can be prevented from returning backward and thus attain a efficient supply.

The fiber material fed from the lower part of the feeder 1 is then subjected by the centrifugal acceleration on the fiber opening cylinder $2_1$. For ensuring the supply of the fiber material without returning backward, the rotating direction of the fiber opening cylinder $2_1$ should be equal to that of the feeder 1. Also, it is preferable for averting damage to the fiber material that the centrifugal acceleration of the fiber opening cylinder $2_1$ is lower than that of the other three fiber opening cylinders $2_2$, $2_3$, $2_4$. Morover, the fiber opening cylinder $2_2$ rotates in the opposite direction of the fiber opening cylinder $2_1$ arranged next to the feeder 1. The fiber material hence passes between the two cylinders $2_1$, $2_2$ directly without combing effects and then, is beaten against the inner wall of the housing 3 by the centrifugal acceleration force. The higher the centrifugal acceleration on the fiber opening cylinders $2_1$, $2_2$, $2_3$, $2_4$, the more the fiber material is opened. More specifically, it is sufficient that at least one of the fiber opening cylinders $2_1$, $2_2$, $2_3$, $2_4$ provides not less than $3.4\times10^5$ cm/sec$^2$ of the centrifugal acceleration. If the centrifugal acceleration is less than $3.4\times10^5$ cm/sec$^2$, the fiber opening action will be declined. It is desired that the fiber opening cylinder be further away from the feeder 1 rotates at a higher or constant rate of centrifugal acceleration.

The opened fiber through the fiber opening cylinders $2_1$, $2_2$, $2_3$, $2_4$ is then unloaded from the opening 5 of the housing 3 at the fiber opening cylinder $2_4$ and falls down onto the conveyor 7 where it is accumulated in the form of a non-directional fiber web. The unloading of the opened fiber is executed by the centrifugal acceleration force of the fiber opening cylinder $2_4$ and the fiber material is thus subjected to concentrate in one direction tangential to the circumference of the fiber opening cylinder $2_4$. This will of course be prevented by the air flow of the air shower device 6. The air flow should not be directly applied to the opened fiber for averting the generation of turbulent flow which may disturb free falling of the fiber material and thus, produce a less uniform fiber web. The air flow is desirably applied so that a laminar flow of air of neighborhood is generated.

The opened fiber accumulated on the conveyor 7 is pressed down by the sucking action of the suction box 8 for forming a fiber web with a proper strength which can thus be handled.

As set forth above, the fiber web producing apparatus according to the present invention allows the fiber opening action to be carried out not with the combing action by the use of workers or strippers in the prior art but by beating of the fiber material against the inner wall of a housing. In the apparatus of the invention, any two adjacent fiber opening cylinders of the fiber web producing apparatus rotate in opposite directions so that the fiber material can be beaten against the inner wall of the housing by means of a centrifugal acceleration force on the fiber opening cylinders while common combing actions rarely occur. Also, the fiber opening cylinders, except the last cylinder at the outlet end, are enclosed in the housing with the exception of the fiber transfer opening, whereby the fiber material will be prevented from spreading out and thus is beaten against the inner wall of the housing favorably for fiber opening action. The opened fiber is then unloaded from the last cylinder at the outlet end to fall down spontaneously, thus forming a non-directional fiber web.

The air shower device is also provided above the unloading point of the last fiber opening cylinder for generating a constant flow of air which indirectly causes the spreading action of the opened fiber during free falling. Accordingly, a non-directional uniform fiber web is produced.

The fiber web producing method of the present invention is designed for use with the foregoing fiber web producing apparatus, in which any two adjacent fiber opening cylinders are rotated in opposite directions and simultaneously, a centrifugal acceleration of more than $3.4\times10^5$ cm/sec$^2$ which is developed on at least one of the fiber opening cylinders is applied to the fiber material. The centrifugal acceleration causes the fiber material to beat against the inner wall of the housing at a high impact so that the fiber material can be opened sufficiently.

The fiber web producing apparatus of the present invention is arranged for throwing the fiber material by means of a centrifugal acceleration force towards the inner wall of the housing for beating. This will allow a particularly stiff fiber material, which is difficult to open by a conventional dry method, to be opened.

Also, the fiber web producing apparatus of the present invention has a housing or enclosure so that when the fiber material fed together with a powder material from a feeder, the powder material can be distributed uniformly due to the action of centrifugal acceleration without spreading outwardly. As a result, a fiber web containing the uniformly distributed powder material can be obtained.

A fiber web comprising two or more types of opened fiber materials are arranged in which the containing ratio of each fiber material almost continuously increases or decreases and there is no abrupt change of the physical properties in thickness direction, and its producing method, will now be described in conjunction with the apparatus shown in FIG. 1. The apparatus for producing such a fiber web is similar in construction to the apparatus of FIG. 1 and will be explained in no further detail.

Two or more types of fiber materials are fed from the feeder 1 shown in FIG. 1 and opened by beating against the inner wall of the housing 3 by means of centrifugal acceleration on the fiber opening cylinders $2_1$, $2_2$, $2_3$, $2_4$.

Figure 3:
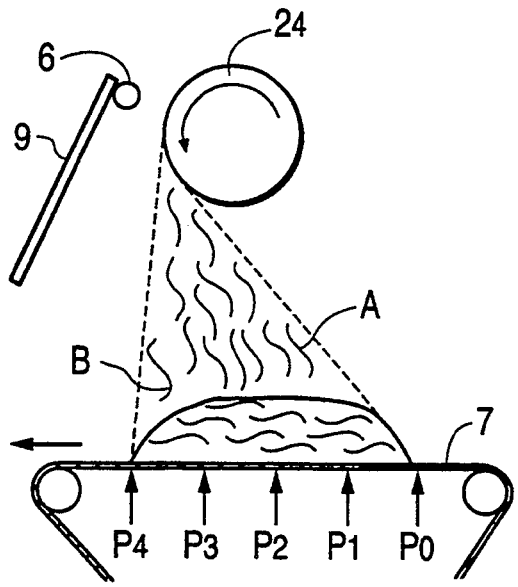
FIG. 3 is a schematic view of a fiber web produced from two or more fiber materials according to the present invention.

When the fiber materials are different in fiber diameter etc., they will vary in the peeling resistance on the last fiber opening cylinder $2_4$ at the outlet end. Hence, the two or more fiber materials fed from the feeder 1 are accumulated at their respective locations on the conveyor 7 and are released from the last fiber opening cylinder $2_4$ at intervals of time due to variations in peeling resistance. A resultant fiber web contains each fiber material which the containing ratio of the each fiber material gradually increases or decreases in the direction of the thickness of the fiber web. More specifically, if two different fiber materials A and B are unloaded from the last fiber opening cylinder $2_4$ which rotates counter-clockwise, the fiber A which is high in peeling resistance tends to accumulate in the back or right side, as shown in FIG. 3, on the conveyor 7 which runs from right to left, while the other fiber B which is low in peeling resistance is likely accumulated in the forward or left side on the conveyor 7 in FIG. 3. It is now assumed that the reference point is $P_0$. As the conveyer 7 moves from the right to left direction of FIG. 3, the fiber materials start accumulating mostly the fiber A from the point $P_0$ on the conveyor 7 and about the point $P_1$, the fiber B accompanies the fiber A. The fiber B is then increased gradually in accumulation towards the point $P_2$. At the point $P_2$, the containing ratio of the two fiber materials A and B become almost equal. The fiber B is then accumulated more than the fiber A towards the point $P_3$. At the point $P_4$, the fiber B is mostly accumulated while the fiber A is less accumulated. In the thickness direction of the fiber web, it contains the fiber A mostly at the lower or conveyor side. As the containing ratio of fiber A decreases, the containing ratio of fiber B increases gradually in the direction of the fiber web. Similarly, if three different types of fiber materials are fed, a resultant fiber web has a containing ratio between the three materials and which varies gradually due to variations in the peeling resistance.

Preferably, the containing ratio of each individual fiber material increases or decreases through 100% of the thickness of the fiber web. It will however be acceptable if 60% of the thickness is covered.

The peeling resistance of a fiber material to the fiber opening cylinder $2_4$ at the outlet end depends on its fiber diameter, specific gravity, fiber length, degree of crimp, surface smoothness, resiliency, etc. In common, those factors tend to act in combination rather than independently, thus providing a different peeling resistance. In addition, the peeling resistance is varied by the shape and size of the sawtooth arrangement of the metallic wire 2*a* mounted on the surface of the fiber opening cylinder.

Particularly, the fiber diameter largely affects the peeling resistance of a fiber material to the last fiber opening cylinder $2_4$. In case of two fiber materials, one has preferably a diameter two times, or more preferably three times, larger than that of the other. If three fiber materials are used, the largest diameter material is preferably more than two times, more preferably three times, greater than that of the other two materials and also, the medium diameter material is more than two times, preferably three times, greater than that of the smallest. In the same manner, the relation between four or more fiber materials may be determined preferably.

Similar to those described previously, for example, regenerated fiber such as rayon, half-synthetic fiber such as acetate fiber, vegetable fiber such as cotton, animal fiber such as wool, mineral fiber such as asbestos, inorganic fiber such as glass or carbon fiber, and synthetic fiber such as polyamide, polyester, or polypropylene fiber etc. are used as the fiber materials but not limitative.

The two or more fiber materials fed from the feeder 1 are opened by the same manner as above described to form a non-directional fiber web.

In this method the fiber materials unloaded from the last fiber opening cylinder 2n by a centrifugal acceleration force are different in physical characteristics including fiber diameter etc. and are different in the peeled off position on the cylinder 2n and thus, accumulated on the conveyor 7 at different locations. Accordingly, the resultant fiber web contains each individual fiber material which increases or decreases gradually in the containing ratio to the thickness direction of the fiber web.

More specifically, the fiber web comprises two or more fiber materials which the containing ratio of each fiber material gradually increases or decreases to the direction of the thickness of the fiber web so that no abrupt change in physical properties is attained. As a result, the fiber web is successfully used as a filter, a battery separator, an FRP substrate, an adhesive tape, or the like.

The fiber web according to the present invention has fiber materials which are opened properly and require no further fiber opening action, thus providing a uniform fiber web.

As another embodiment of the present invention, an apparatus and a method of producing a fiber web from an organic fiber material which is relatively small in fiber diameter and long in fiber length are described now.

If such an apparatus as shown in FIG. 1 is used, an organic fiber material which has a fiber thickness as small as less than 2 deniers and a fiber length of more than 30 mm tends to be released from the last cylinder of three or more fiber opening cylinders with much difficulty. This generates neps or fiber clusters by entanglement.

Figure 7:
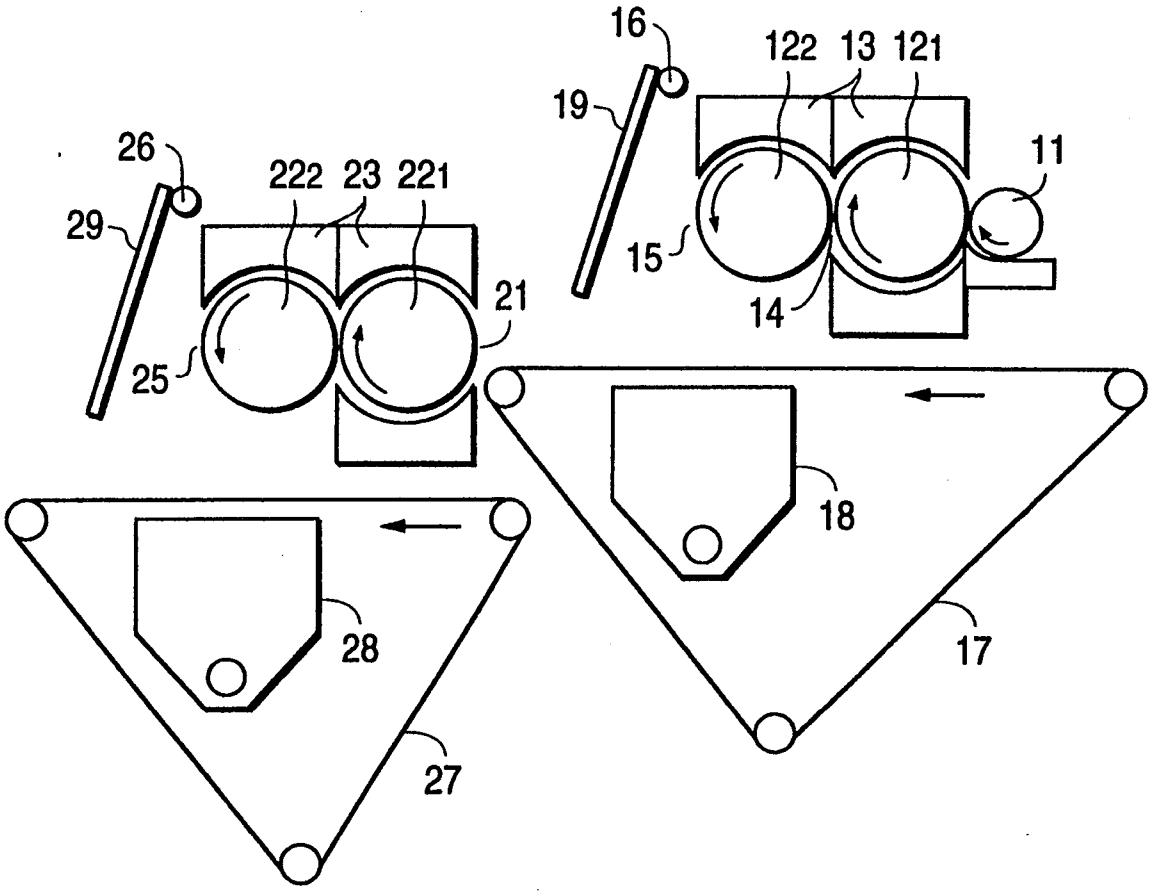
FIG. 7 is a cross sectional view of a fiber web producing apparatus showing another embodiment of the present invention.

Hence, a specific apparatus shown in FIG. 7 or a modified equivalent will be provided for producing a fiber web from a fiber material which tends to generate unwanted neps.

The apparatus of FIG. 7 comprises combination of two or more of the apparatus shown in FIG. 1. However, in this embodiment, each stage of the apparatus contains two fiber opening cylinders instead of four fiber opening cylinders of the apparatus disclosed in FIG. 1.

Although the apparatus shown in FIG. 7 comprises two stages, however, three or more stages will be preferred.

In the apparatus of this embodiment, the fiber material is less loaded during transfer and will hardly be deteriorated in quality and also, prevented from generating neps.

It will be understood that the apparatus of FIG. 7 is also used with equal success for producing a fiber web from a nep-absent fiber material, e.g. inorganic fiber, organic fiber having a large fiber diameter, organic fiber having a small fiber length, or organic fiber having a high rigidity, as well as the nep generating fiber materials.

The action of the apparatus shown in FIG. 7 will be explained.

The apparatus comprises a first fiber opening stage comprising a feeder 11 for supply of a fiber material, two fiber opening cylinders $\mathbf{12}_1$, $\mathbf{12}_2$ arranged next to the feeder 11 for rotation in opposite directions to each other for transferring and opening the fiber material fed from the feeder 11 and having metallic wires mounted on the outer surface thereof, a housing 13 provided for enclosing the two fiber opening cylinders $\mathbf{12}_1$, $\mathbf{12}_2$ and having a fiber transfer opening 14 between the two fiber opening cylinders $\mathbf{12}_1$, $\mathbf{12}_2$ and at the outlet end a release opening 15 for unloading the opened fiber from the outlet end fiber opening cylinder $\mathbf{12}_2$, a conveyor 17 for receiving the opened fiber unloaded from the fiber opening cylinder $\mathbf{12}_2$, and a suction box 18 arranged beneath the conveyor 17 for drawing the opened fiber towards the conveyor 17 by a sucking action, and a second fiber opening stage comprising two fiber opening cylinders $\mathbf{22}_1$, $\mathbf{22}_2$ arranged for rotation in opposite directions to each other for transferring and opening the fiber material fed from the conveyor 17 of the first fiber opening stage and having metallic wires mounted on the outer surface thereof, a housing 23 provided for enclosing the two fiber opening cylinders $\mathbf{22}_1$, $\mathbf{22}_2$ and having a fiber transfer opening 24 between the two fiber opening cylinders $\mathbf{22}_1$, $\mathbf{22}_2$, and at the outlet end a release opening 25 for unloading the opened fiber from the outlet end fiber opening cylinder $22_2$, a conveyor 27 for receiving the opened fiber unloaded from the fiber opening cylinder $22_2$ and a suction box 28 arranged beneath the conveyor 27 for drawing the opened fiber towards the conveyor 27 by a sucking action. Two air shower devices 16, 26 are provided at the upper left of their respective housings 13, 23. Also, two covers 19, 29 are provided at the left of their respective housings 13, 23 thus to extend downward at an angle as shown in FIG. 7. The air shower devices 16, 26 are preferably arranged to deliver a flow of air along the inner wall of the covers 19, 29 in a lower left direction in order to avert direct application to the opened fiber. Such and other requirements are similar to those described with the apparatus of FIG. 1 and will not further be explained.

In the apparatus, a fiber web will be produced from a fiber material fed from the feeder 11 by a like manner as of the apparatus of FIG. 1. In this apparatus, it is sufficient that, at least one of the fiber opening cylinders $12_1$, $12_2$, $22_1$, $22_2$ is driven to produce a centrifugal acceleration of more than $3.4\times10^5$ cm/sec$^2$.

The apparatus of FIG. 7 is shown as the apparatus comprising the first and second fiber opening stages for easy understanding and a simplified explanation. However, preferably, the apparatus may contain three or more stages. In practice, the apparatus when having a large number of fiber opening stages is disadvantageous economically and causes more damage to a fiber material during the opening action. It is then recommended that the apparatus should contain not more than five or six stages.

For application of the foregoing apparatus and method of the present invention, a method of producing a fiber web in which active carbons are adhered to the fibers thereof will now be described together with the fiber web producing apparatus of the present invention.

According to the present invention, the fiber web producing method allows a given amount of active carbon powder to be adhered to the fibers of a fiber sheet without use of adhesive.

Such a fiber sheet which active carbon powders adhered on the fibers thereof without the use of adhesive agents is produced by the fiber web producing apparatus shown in FIG. 1. In this apparatus, a fiber material and a given amount of carbonizable resin powder fed from the feeder 1 are processed to a fiber sheet containing the carbonizable resin powder at approximately uniform density. The fiber sheet is then baked and activation treated. Preferably, when phenol resin powder is used as the carbonizable resin powder, a resultant web sheet exhibits high absorptivity for ammonia, trimethytamine, or the like.

The method of producing the fiber sheet being adhered active carbons will be described in more detail.

According to the present invention, the fiber material is used as substrate for a powder form of active carbon (referred to as "active carbon" hereinafter) being adhered on the fiber material in a stable state. The carbonizable resin powder is baked and activation treated in the form of powder particles so that a resultant active carbon sheet is increased in absorptivity. For this purpose, the fiber material should have a high heat resistance. A common baking action for activation treatment is conducted at over 400° C. Hence, preferably glass fiber, silica fiber, alumina fiber, ceramic fiber, silicon carbide fiber, quartz fiber, and rock wool etc. are used as the fiber material, however, it is not limited in these examples.

The carbonizable resin powder is adhered to such a heat-resistant fiber sheet by static electricity. As the carbonizable resin powder is adhered to the fiber without use of adhesive agents, a resultant active carbon fiber web after baking ensures no decline in absorptivity.

As the carbonizable resin powder, for example, phenol resin, epoxy resin, and PAN (polyacrylonitrile) resin etc. are mentioned. Among them, the phenol resin is most preferred as having a higher absorptivity for ammonia and trimethylamine. Also, the carbonizable resin powder is preferably 5 to 100 μm in particle diameter for ease of bonding to the fiber material using static electricity and baking for activation treatment with efficiency.

The phenol resin is commonly formed by condensation reaction between a phenol material and an aldehyde material. As the phenol material, phenol, cresol, xylenol, resorcin, and phenol sulfonic acid are used, while as the aldehyde material, formaldehyde, acetaldehyde, and furfural are used. Particularly, an active carbon produced by baking of phenol resin for activation treatment exhibits a high absorptivity for ammonia and trimethylamine, as disclosed in Japanese Patent Application Laid-open No. 177011/1982.

A method of producing the fiber sheet having adhered carbonizable resin powders, with the foregoing apparatus of the present invention, starts with feeding of both the fiber material and the carbonizable resin powders from the feeder 1. This method allows particles of the carbonizable resin powders to be bonded to the fiber material by the action of static electricity during the fiber opening action so that a fiber web being adhered the carbonizable resin can be produced with no difficulty.

The opened fibers being adhered the carbonizable resin powders are unloaded from the last fiber opening cylinder $2_4$ at the outlet end through the opening 5 of the housing 3. If the amount of carbon resin powder exceeds the fiber material from the feeder 1, the excessive portions which can not be adhered to the fiber material are dispersed in the fiber sheet.

The excessive portions of the carbonizable resin powder released from the last fiber opening cylinder $2_4$ are absorbed by the sucking action of the suction box 8 for recovery, while the fiber material carrying a given amount of the carbonizable resin powders is accumulated on the conveyor 7 and shaped to a sheet form having strength enough to be handled. The fiber sheet is then baked and activation treated to a fiber sheet having adhered active carbons as one embodiment of the present invention.

The baking treatment and the activation treatment may be carried out separately or simultaneously and will not be limiting. For separate treatment, the baking is conducted under a non-oxidation atmosphere at a temperature of more than 400° C. or preferably, 500° C. The activation treatment is executed under oxidation gas, e.g. steam, carbon dioxide, oxygen, or air, at a temperature of over 400° C. For simultaneous treatment, both can be implemented under oxidation gas, e.g. steam, carbon dioxide, oxygen, or air, at a temperature of over 400° C.

Active carbon is generally available in the form of particles, fiber, and shaped solid. The active carbon is however less manageable and unstable in keeping its shape and thus, has to be bonded to a substrate. If the bonding employs an adhesive, the surface area of active carbon particles is decreased thus lowering the absorptivity. Although the active carbon fiber is stable in form, it has low strength and can hardly be processed to a desired shape. Also, an active carbon of a e.g. tubular, planer, or honeycomb shape requires specific molds or techniques in fabrication and are unsuitable for common use.

According to the present invention, the carbonizable resin powders adhered to the fiber sheet are baked and activation treated in the form of powder so that each resin particle can uniformly be carbonized and activated to an active carbon of high absorptivity. Also, the active carbons are bonded to the fiber material by the action of static electricity and there is no decline in the absorptivity caused by the presence of an adhesive. The fiber sheet having the adhered active carbons is easily formed to any shape and applicable to a variety of industrial requirements. As the carbonizable resin powder, when phenol resin and more preferably, a specific phenol resin material such as that disclosed in Japanese Patent Application Laid-open No. 177011/1982 is used, a resultant fiber sheet having the adhered active carbons exhibits a higher absorptivity for ammonia and trimethylamine.

Furthermore, as the carbonizable resin powder is baked and activation treated after being bonded by static electricity to the fiber, its processing procedure is facilitated and a resultant fiber sheet having the adhered active carbons has a uniform distribution of the carbonizable resin powders.

As set forth above, the present invention provides an improved fiber sheet having adhered active carbons which has excellent absorptivity, shapability, and thus is suited for common use, and its producing method which can also correspond to a variety of industrial applications.

EXAMPLE 1

Using the apparatus shown in FIG. 1, a fiber web of 150 g/m$^2$ was produced from glass fibers (13 μm in fiber diameter and 10 mm in fiber length) fed from the feeder 1 through a fiber opening with the fiber opening cylinders $2_1$, $2_2$, $2_3$, $2_4$ and unloaded from the last fiber opening cylinder 24 at the outlet end onto the conveyor 7. Both the feeder 1 and the fiber opening cylinder $2_1$ were arranged next to the feeder 1 of the apparatus and rotated in a clockwise direction as shown in FIG. 1, while the remaining fiber opening cylinders were rotated in opposite directions to that of the preceding cylinder. The fiber opening cylinders $2_1$, $2_2$, $2_3$, $2_4$ were 5 cm in radius and their rotating speeds were 2500, 3000, 3600, and 3600 revolutions per minute respectively. The conveyor 7 was driven at a speed of 2 m/min from right to left of FIG. 1. The air shower device 6 was arranged to provide a flow of air along the inner wall of the cover 9 for no direct application to the opened fiber. The flow of air was at 1 kgf/cm of pressure.

The resultant fiber web was found to be uniformly open and non-directional.

A spray of a binder was applied onto the fiber web which was then dried out to produce a nonwoven fabric of 180 g/m$^2$.

Experiment 1

Using the apparatus shown in FIG. 1, a fiber web was produced from a mixture of 50% by weight of polyvinyl alcohol fibers (5.9 μm in fiber diameter and 10 mm in fiber length) and 50% by weight of polyester fibers (12.4 μm in fiber diameter and 10 mm in fiber length) fed from the feeder 1 through a fiber opening with the fiber opening cylinders $2_1$, $2_2$, $2_3$, $2_4$ and unloaded from the last fiber opening cylinder $2_4$ at the outlet end onto the conveyor 7. Both the feeder 1 and the fiber opening cylinder $2_1$ were arranged next to the feeder 1 of the apparatus and rotated in a clockwise direction as shown in FIG. 1, while the remaining fiber opening cylinders were rotated in opposite directions to that of the preceding cylinder. The fiber opening cylinders $2_1$, $2_2$, $2_3$, $2_4$ were 5 cm in radius and rotated at a speed of 3600 revolutions per minute. While the conveyor 7 remained unactuated for accumulation of the opened fiber, the air shower device 6 was arranged to provide a flow of air at a pressure of 1 kgf/cm$^2$.

The resultant fiber web was cut to the width direction of the conveyor 7 into pieces of 2 cm wide. Each fiber piece was examined for the fiber content ratio between the polyvinyl alcohol fibers (PVA) and the polyester fibers (PET) by dissolving the polyvinyl alcohol fibers.

Figure 4:
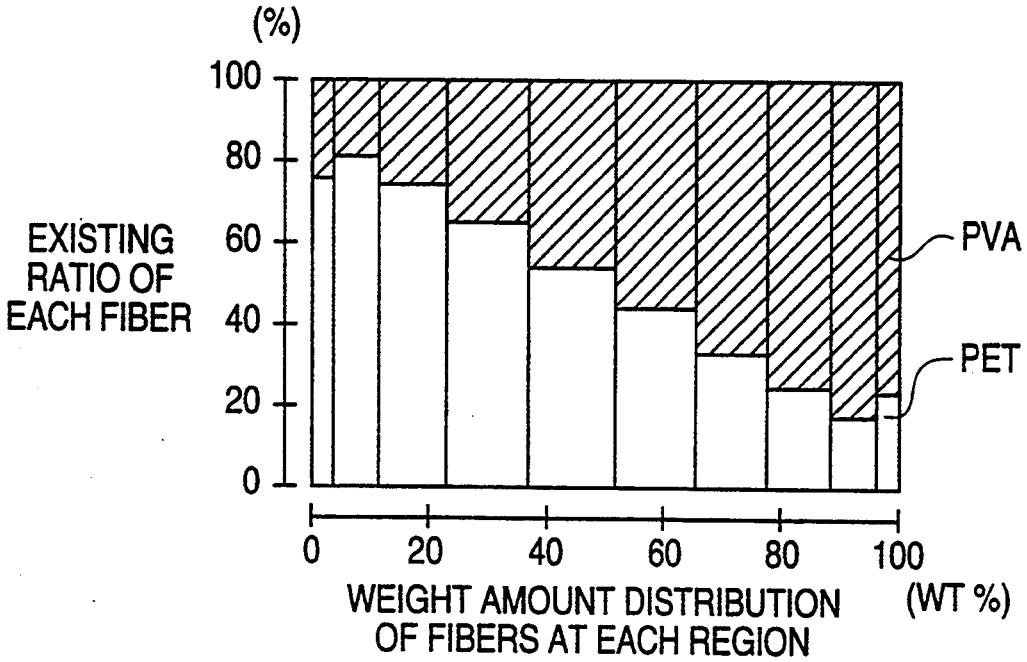
FIG. 4 is a graphic diagram showing the result of Experiment 1 of the present invention.

The result is shown in Table 1 and FIG. 4 in which the ratio between the two different fiber materials is varied corresponding to their types and the fiber diameter.

Experiment 2

Figure 5:
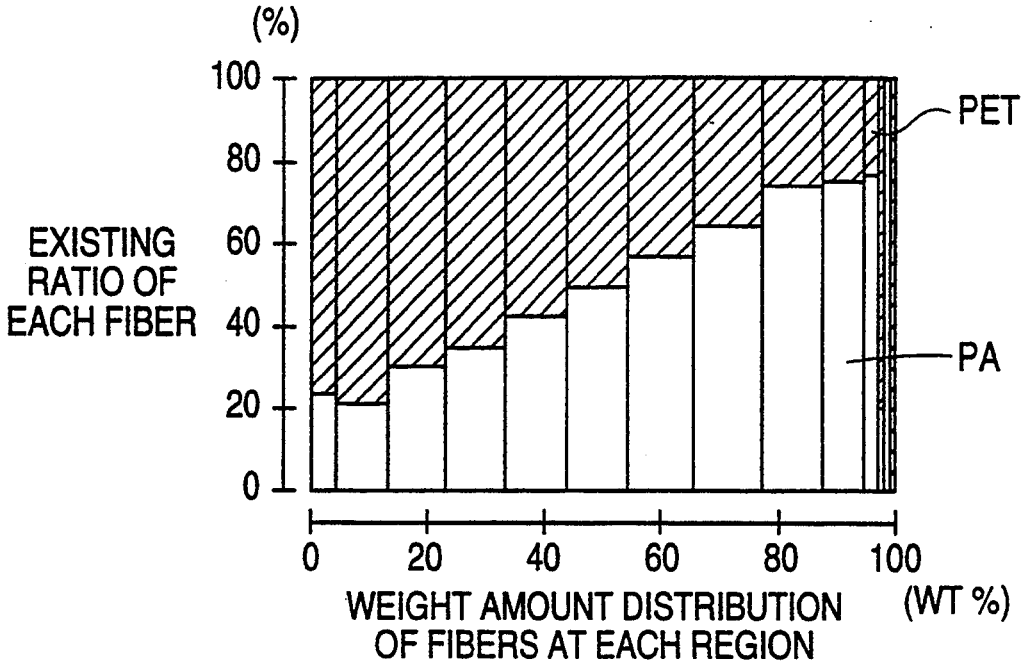
FIG. 5 is a graphic diagram showing the result of Experiment 2 of the present invention.

In the same manner as that described in Experiment 1, a mixture of 50% by weight of polyester fibers (6.2 μm in fiber diameter and 10 mm in fiber length) and 50% by weight of polyamide fibers (6.8 μm in fiber diameter and 30 mm in fiber length) fed from the feeder 1 was processed to a fiber web which was then cut to the width direction of the conveyor 7 into pieces of 2 cm wide and each fiber piece was examined for the fiber content ratio between the polyester fibers (PET) and the polyamide fibers (PA) by dissolving the polyamide fibers using formic acid. The result is shown in Table 2 and FIG. 5 in which the ratio between the two different fiber materials is varied corresponding to their types and the fiber length.

Experiment 3

Figure 6:
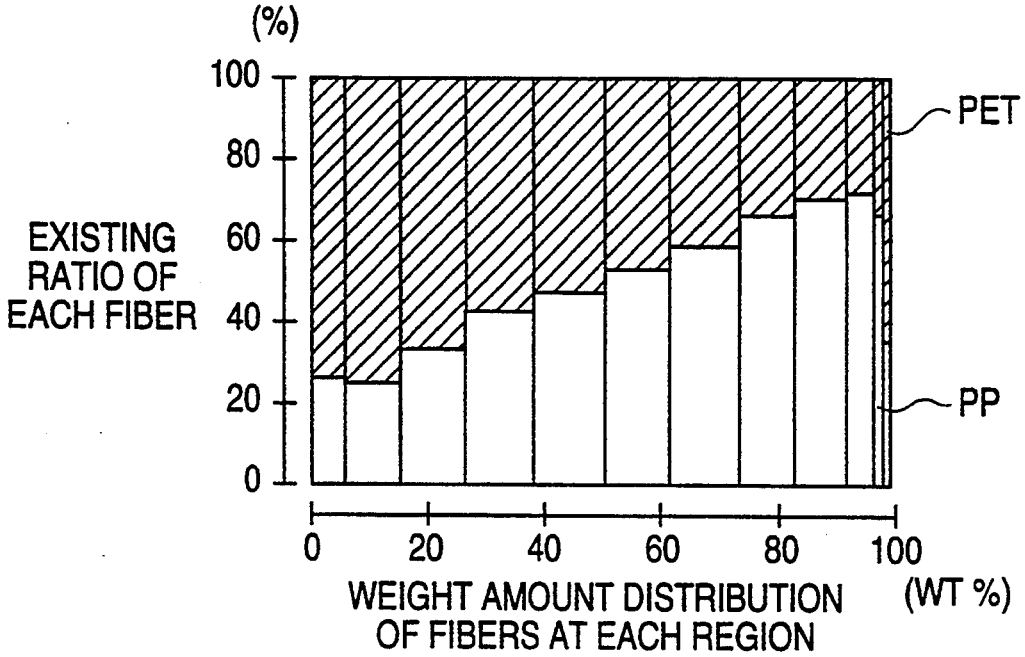
FIG. 6 is a graphic diagram showing the result of Experiment 3 of the present invention.

In the same manner as that described in Experiment 1, a mixture of 50% by weight of polyester fibers (6.2 μm in fiber diameter, 10 mm in fiber length, and 16 crimps per inch) and 50% by weight of polypropylene fibers (8.9 μm in fiber diameter, 10 mm in fiber length, and no crimp arranged) fed from the feeder 1 was processed to a fiber web which was then cut to the width direction of the conveyor 7 into pieces of 2 cm wide and each fiber piece was examined for the fiber content ratio between the polyester fibers (PET) and the polypropylene fibers (PP) by dissolving the polyester fibers using phenol. The result is shown in Table 3 and FIG. 6 in which the ratio between the two different fiber materials is varied corresponding to their fiber types and the number of crimps.

EXAMPLE 2

A mixture of 45 g of polyester fibers (19.6 μm in fiber diameter and 10 mm in fiber length) and 34 g of polyamide fibers (6.8 μm in fiber diameter and 10 mm in fiber length) was processed to a fiber web of 90 g/m in weight by the same manner that of described in Experiment 1, except that conveyor 7 was driven at a speed of 2 m/min from right to left of FIG. 1. Then, using an acrylic ester emulsion, the fiber web was solidified to a nonwoven fabric of 180 g/m$^2$ in weight.

Peeling Test

The nonwoven fabric of Example 2 was bonded by a polyamide hot melting adhesive to a woven fabric. The web was cut into 5×7.5 (cm) sections to produce five sample pieces. The sample pieces were then examined for resistance to peeling with a tension strength tester ("Tensiron" by Toyo Boldwin Co.) using a drawing speed of 30 cm/min and their resultant measurements were averaged. The nonwoven fabric of Example 2 had enough peeling resistance and exhibited a peeling resistance of as high as 2.6 kgf.

EXAMPLE 3

A mixture of 50% by weight of polytetrafluoethylene (PTFE) fibers (10.5 μm in fiber diameter and 10 mm in fiber length) and 50% by weight of aromatic polyamide fibers (trade name "Kevlar" by E. I. Dupont, 6.1 μm in fiber diameter, and 10 mm in fiber length) was processed to a fiber web of 120 g/m$^2$ in weight by the same manner as that described in Experiment 1, except that conveyor 7 was driven at a speed of 2 m/min from right to left of FIG. 1.

The resultant fiber web was found comprising the PTFE fibers of white color at the upper layer thereof and the aromatic polyamide fibers of yellow color at the lower layer which was in contact with the conveyor 7. The gradual variation of these two colors was also observed when viewed in cross section.

TABLE 1

| Containing ratio between fiber materials at cut points (% by weight) | | | | | | | | | | | |
|---|---|---|---|---|---|---|---|---|---|---|---|
| cm | 0 | 2 | 4 | 6 | 8 | 10 | 12 | 14 | 16 | 18 | Total |
| | ~2 | ~4 | ~6 | ~8 | ~10 | ~12 | ~14 | ~16 | ~18 | ~20 | |
| PVA | 0.9 | 1.5 | 2.8 | 4.6 | 6.7 | 7.8 | 8.4 | 8.1 | 6.4 | 2.8 | 50 |
| | (24) | (19) | (25) | (35) | (46) | (56) | (67) | (75) | (82) | (76) | |
| PET | 2.9 | 6.6 | 8.6 | 8.7 | 7.9 | 6.1 | 4.2 | 2.7 | 1.4 | 0.9 | 50 |
| | (76) | (81) | (75) | (65) | (54) | (44) | (33) | (25) | (18) | (24) | |
| Total | 3.8 | 8.1 | 11.4 | 13.3 | 14.6 | 13.9 | 12.6 | 10.8 | 7.8 | 3.7 | 100 |

Values in () represent a proportion (%) of each fiber material.

TABLE 2

| Containing ratio between fiber materials at cut points (% by weight) | | | | | | | | | | | | | | | |
|---|---|---|---|---|---|---|---|---|---|---|---|---|---|---|---|
| cm | 0 | 2 | 4 | 6 | 8 | 10 | 12 | 14 | 16 | 18 | 20 | 22 | 24 | 26 | Total |
| | ~2 | ~4 | ~6 | ~8 | ~10 | ~12 | ~14 | ~16 | ~18 | ~20 | ~22 | ~24 | ~26 | ~28 | |
| PET | 3.7 | 7.2 | 7.1 | 6.6 | 6.4 | 5.3 | 4.8 | 4.0 | 2.8 | 1.6 | 0.5 | 0.0 | 0.0 | 0.0 | 50 |
| | (77) | (79) | (70) | (65) | (58) | (51) | (43) | (35) | (26) | (23) | (22) | (0) | (0) | (0) | |
| PA | 1.1 | 1.9 | 3.0 | 3.5 | 4.7 | 5.2 | 6.4 | 7.4 | 7.8 | 5.4 | 1.8 | 1.0 | 0.6 | 0.2 | 50 |
| | (23) | (21) | (30) | (35) | (42) | (49) | (57) | (65) | (74) | (77) | (78) | (100) | (100) | (100) | |
| Total | 4.8 | 9.1 | 10.1 | 10.1 | 11.1 | 10.5 | 11.2 | 11.4 | 10.6 | 7.0 | 2.3 | 1.0 | 0.6 | 0.2 | 100 |

Values in () represent a proportion (%) of each fiber material.

TABLE 3

| Containing ratio between fiber materials at cut points (% by weight) | | | | | | | | | | | | | |
|---|---|---|---|---|---|---|---|---|---|---|---|---|---|
| cm | 2 | 4 | 6 | 8 | 10 | 12 | 14 | 16 | 18 | 20 | 22 | 24 | Total |
| | ~4 | ~6 | ~8 | ~10 | ~12 | ~14 | ~16 | ~18 | ~20 | ~22 | ~24 | ~26 | |
| PET | 3.8 | 7.3 | 7.2 | 6.7 | 6.5 | 5.4 | 4.5 | 3.5 | 2.5 | 1.7 | 0.6 | 0.3 | 50 |
| | (73) | (74) | (66) | (57) | (52) | (47) | (41) | (34) | (29) | (28) | (33) | (60) | |
| pp | 1.4 | 2.6 | 3.8 | 5.0 | 5.9 | 6.2 | 6.6 | 6.7 | 6.1 | 4.3 | 1.2 | 0.2 | 50 |
| | (27) | (26) | (34) | (43) | (48) | (53) | (59) | (66) | (71) | (72) | (67) | (40) | |
| Total | 5.2 | 9.9 | 11.0 | 11.7 | 12.4 | 11.6 | 11.1 | 10.2 | 8.6 | 6.0 | 1.8 | 0.5 | 100 |

Values in () represent a proportion (%) of each fiber material.

EXAMPLE 4

Using the apparatus shown in FIG. 7, a fiber web was produced from polyester fibers (2 denier and 38 mm in fiber length) fed from the feeder 11 through a fiber opening with the fiber opening cylinders $\mathbf{12}_1$, $\mathbf{12}_2$ of the first stage, unloaded from the last fiber opening cylinder $\mathbf{12}_2$ at the outlet end onto the conveyor 17, further opening with the fiber opening cylinders $\mathbf{22}_1$, $\mathbf{22}_2$ of the second stage, and unloaded from the fiber opening cylinder $\mathbf{22}_2$ at the outlet end onto the conveyor 27. Both the feeder 11 and the fiber opening cylinder $\mathbf{12}_1$ arranged next to the feeder 11 of the apparatus were rotated in a clockwise direction as shown in FIG. 7, while the remaining fiber opening cylinders $\mathbf{12}_2$, $\mathbf{22}_1$, $\mathbf{22}_2$ were rotated in opposite directions to that of the preceding cylinder. The fiber opening cylinders $\mathbf{12}_1$, $\mathbf{12}_2$, $\mathbf{22}_1$, $\mathbf{22}_2$ were all 5 cm in radius and their rotating speeds were 1000, 2000, 1500, and 3000 revolutions per minute respectively. The two conveyors 17, 27 were driven at a speed of 2 m/min from right to left of FIG. 7. Both the air shower devices 16, 26 were arranged to provide flows of air along the inner wall of their respective covers 19, 29 with no direct application to the opened fiber. Each flow of air was at 1 kgf/cm$^2$ of pressure.

The resultant fiber web was shown uniformly opened and found neither neps nor breakage.

EXAMPLE 5

Using the apparatus shown in FIG. 1, a fiber sheet was produced from a mixture of 10 g of glass fiber (13 μm in fiber diameter and 10 mm in fiber length) and 10 g of phenol resin powder ("Belpearl S-890" by Kanebo, LTD. 20 μm in average particle diameter) fed from the feeder 1 through dispersing and fiber opening with the fiber opening cylinders $\mathbf{2}_1$, $\mathbf{2}_2$, $\mathbf{2}_3$, $\mathbf{2}_4$ and unloading from the last fiber opening cylinder $\mathbf{2}_4$ at the outlet end onto the conveyor 7 which was running at a speed of 2 m/min. Both the feeder 1 and the fiber opening cylinder $2_1$ arranged next to the feeder 1 of the apparatus were rotated in a clockwise direction in FIG. 1, while the remaining fiber opening cylinders were rotated in opposite directions to that of the preceding cylinder. The fiber opening cylinders $2_1$, $2_2$, $2_3$, $2_4$ were 5 cm in radius and rotated at a speed of 3600 revolutions per minute. The air shower device 6 was arranged to provide a flow of air at a pressure of 1 kgf/cm$^2$ along the inner wall of the cover 9.

For baking and activation treatment with the use of an electric furnace, the fiber sheet was heated under air from room temperature to 300° C. at a rate of 3° C./min and maintained at 300° C. for one hour. In succession, the fiber web was heated at a rate of 5° C./min up to 500° C. and cooled down to room temperature spontaneously. A resultant fiber sheet having the adhered active carbons was examined for characteristics of active carbon using an infrared absorption spectrum (diffuse reflectance spectroscopy) technique. Absorption spectra resulting from the absorption of hydroxyl groups and carboxyl groups were measured at 1600 to 1700 cm$^{-1}$.

Comparative Examples 1 and 2

10 g of the phenol resin powder used in Example 5 was cured by heating at 150° C. for one hour to a plate form of 100×100×1 mm.

The plate was then baked and activated in the same manner as of Example 5 to an active carbon plate (Comparative Example 1). The active carbon plate was ground in a mortar to a powder form (Comparative Example 2).

Ammonia deodorizing Test

Test pieces (0.2 g) of Example 5 and Comparative Example 1 and 2 were put into a 2-liter Erlenmeyer flask and a given amount of ammonia was applied for adjusting the initial concentration to 800 ppm. The concentration was then measured every hour using a detecting tube (made by Gastec). Also, the concentration of ammonia of the same amount in a like flask without test pieces was measured as a blank value. The resultant deodorizing rate to the blank value is shown in FIG. 8.

Trimethylamine Deodorizing Test

The deodorizing rate for trimethylamine was measured using the same manner as of the ammonia deodorizing test, except that the initial concentration was set to 30 ppm. The result is shown in FIG. 9.

Figure 8:
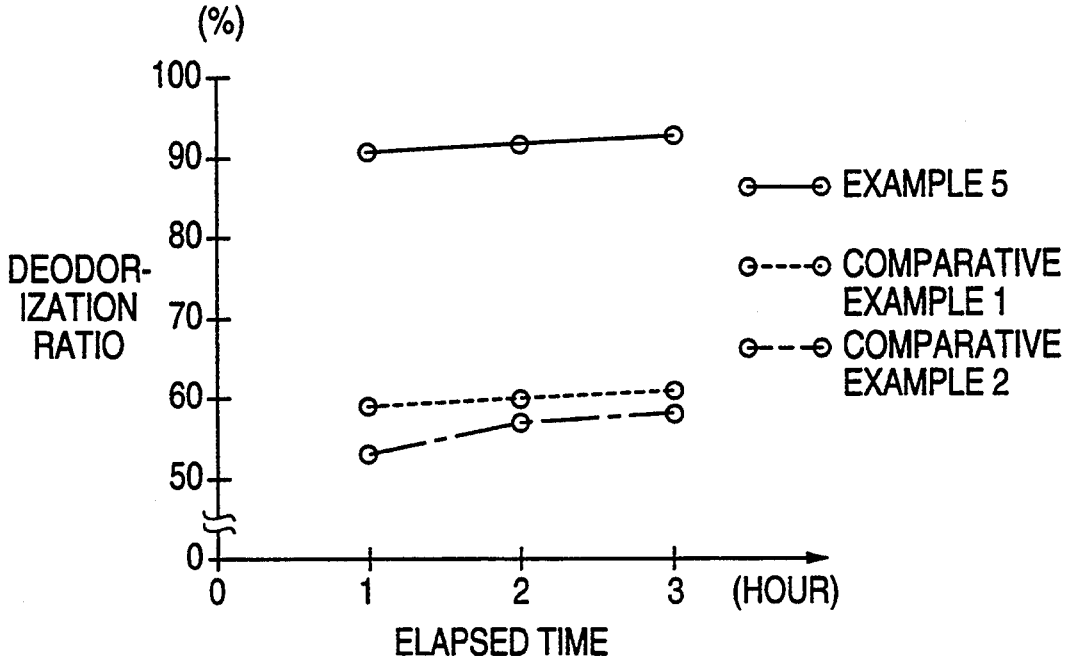
FIG. 8 is a graphic diagram showing the deodorizing rate of a fiber sheet in which active carbons are adhered to the fibers thereof for ammonia of Example 5 and Comparative Examples 1, 2.
Figure 9:
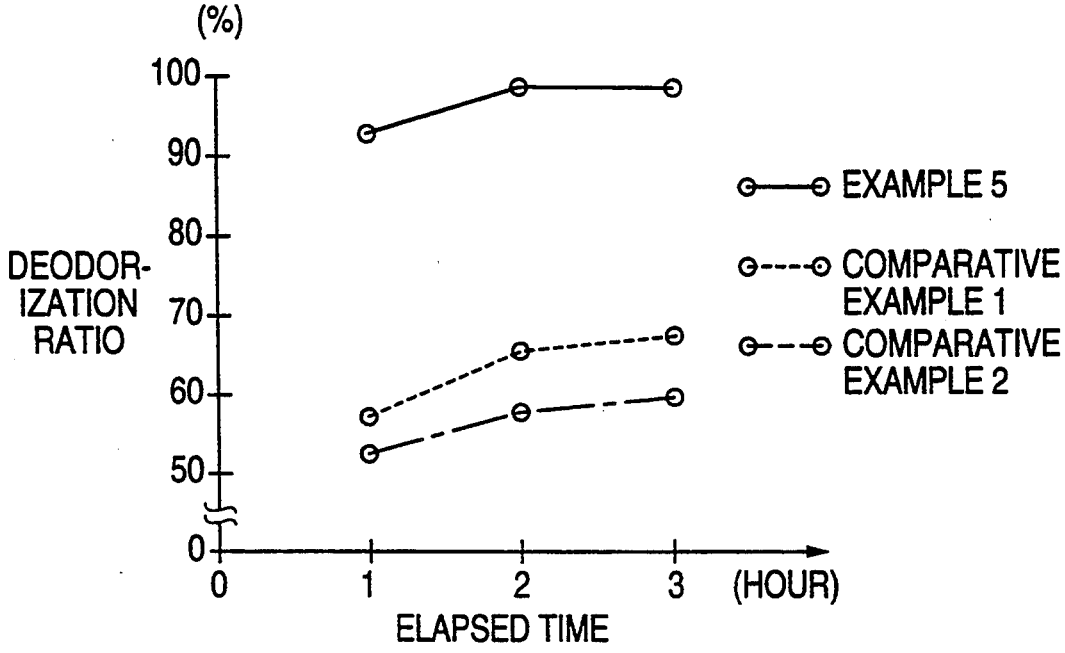
FIG. 9 is a graphic diagram showing the deodorizing rate of a fiber sheet in which active carbons are adhered to the fibers thereof for trimethylamine of Example 5 and Comparative Examples 1, 2.

As apparent from FIGS. 8 and 9, the fiber sheet having the adhered active carbons, owing to phenol resin powder being baked and activated in the form of powder, has improved properties of absorption for ammonia and trimethylamine.

Recovering Test

Figure 10:
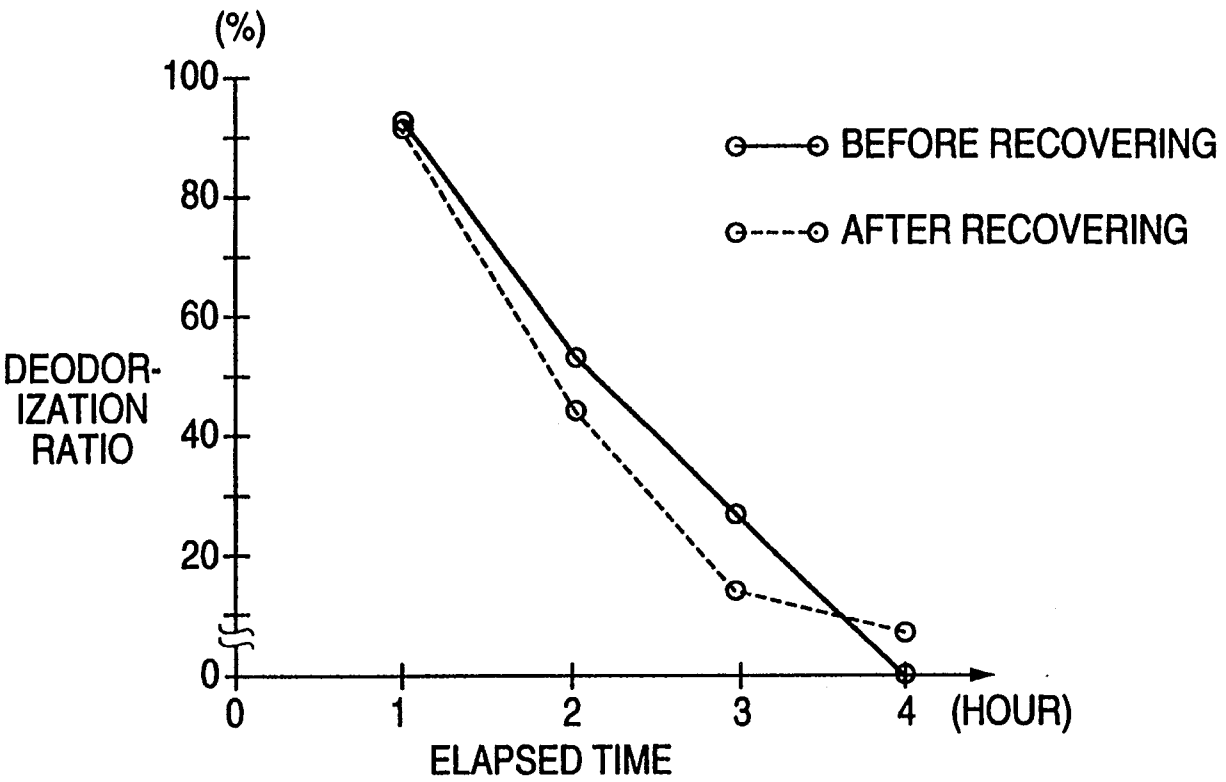
FIG. 10 is a graphic diagram showing the deodorizing rate of a fiber sheet in which active carbons are adhered to the fibers thereof for ammonia before and after the reuse treatment.

A test piece (0.2 g) of Example 5 was put into a 2-liter Erlenmeyer flask and 8 μl of ammonia was added. One hour later, the concentration of ammonia was measured using a detection tube (No. 3M for ammonia measurement, made by Gastec). Then, 8 μl of ammonia was added again. One hour later, the concentration of ammonia was measured. In succession, 8 μl of ammonia was further added. This action was repeated until four hours passed. The test piece was then picked up and dried at 110° C. for three hours for reuse. Then, the same procedure was repeated. As apparent from FIG. 10, the test piece shows almost no change between deodorizing capabilities before and after usage and thus, can be reused. The deodorizing rate is calculated from following equation:

$$\text{Deodorizing rate (\%)} = \left(1 - \frac{\text{Measured concentration}}{\text{Remained concentration} + 800}\right) \times 100$$

where the concentration is expressed in ppm.

We claim:

1. An apparatus for producing a fiber web comprising:

a feeder for supplying a fiber material to an inlet of a housing having smooth inner walls;

a plurality of fiber opening cylinders within said housing having metallic wires mounted to the surface of said fiber opening cylinders wherein the distance from the top of the metallic wires to the inner housing walls is about 0.1–5.0 mm and wherein the blades of said metallic wires are inclined at an angle in a direction which is the same as the direction of rotation of the cylinder, said cylinders being mounted adjacent to one another for transferring and opening the fiber material from the feeder to an outlet of the housing;

a conveyor arranged for receiving opened fiber material from one of the fiber opening cylinders mounted at the outlet of the housing;

a suction box arranged beneath the conveyor for drawing the opened fiber towards the conveyor by a sucking action;

said housing having fiber transfer openings between adjacent fiber opening cylinders; and means for rotating adjacent cylinders in opposite directions, with the rotating speed of each fiber opening cylinder being increased from the fiber opening cylinder at the inlet of the housing to the fiber opening cylinder at the outlet of the housing, and at least one of the plurality of fiber opening cylinders engaged to rotate at a centrifugal acceleration of at least 3.4×10$^5$ cm/sec$^2$ providing beating of the fibers against the smooth walls to promote opening.

2. An apparatus for producing a fiber web comprising at least:

a first fiber opening device comprising a feeder for supplying a fiber material to an inlet of a housing, two fiber opening cylinders mounted adjacent to each other for transferring and opening the fiber material from the feeder to an outlet of the housing through rotation in opposite directions and having metallic wires mounted to the surface of said fiber opening cylinders, wherein the blades of said metallic wires are inclined at an angle in a direction which is the same as the direction of rotation of the cylinder, a housing having smooth inner walls enclosing the two fiber opening cylinders, wherein the distance from the top of the metallic wires to the inner housing walls is about 0.1–5.0 mm, and having a fiber transfer opening between adjacent fiber opening cylinders, a conveyor arranged for receiving the opened fiber unloaded from the fiber opening cylinder mounted at the outlet of the housing, a suction box arranged beneath the conveyor for drawing the opened fiber towards the conveyor by a sucking action, and a means for rotating adjacent cylinders in opposite directions with the rotating speed of each fiber opening cylinder being increased from the fiber opening cylinder at the inlet of the housing, and at least one of fiber opening cylinders engaged to rotate at a centrifugal acceleration of at least $3.4\times10^5$ cm/sec$^2$, said centrifugal acceleration providing beating of the fibers against the smooth walls to promote opening; and a second fiber opening device comprising two fiber opening cylinders mounted adjacent to each other for transferring and opening the fiber material fed from the conveyor of the first fiber opening device through rotation in opposite directions and having metallic wires mounted to the surface of said fiber opening cylinders, wherein the blades of said metallic wires are inclined at an angle in a direction which is the same as the direction of rotation of the cylinder, a housing having smooth inner walls enclosing the two fiber opening cylinders, wherein the distance from the top of the metallic wires to the inner housing walls is about 0.1–5.0 mm, and having a fiber transfer opening between adjacent fiber opening cylinders, a conveyor arranged for receiving the opened fiber from the fiber opening cylinder mounted at the outlet of the housing, a suction box arranged beneath the conveyor for drawing the opened fiber towards the conveyor by a sucking action, and a means for rotating adjacent cylinders in opposite directions with the rotating speed of each fiber opening cylinder being increased from the fiber opening cylinder at the inlet of the housing, and at least one of fiber opening cylinders engaged to rotate at a centrifugal acceleration of at least $3.4\times10^5$ cm/sec$^2$.

* * * * *